United States Patent [19]

Kassner et al.

[11] Patent Number: 4,571,830

[45] Date of Patent: Feb. 25, 1986

[54] HAIR CLIPPER

[76] Inventors: Jochen Kassner, Westring 23, 6231 Schwalbach/Ts; Friedrich Schreiber, Homburger Landstr. 765, 6000 Frankfurt/M 56, both of Fed. Rep. of Germany

[21] Appl. No.: 496,296

[22] Filed: May 16, 1983

[30] Foreign Application Priority Data

May 14, 1982 [DE] Fed. Rep. of Germany ..... 3218208

[51] Int. Cl.[4] ..... B26B 19/00

[52] U.S. Cl. ..... 30/200; 30/233

[58] Field of Search ..... 30/223, 200, 233, 286

[56] References Cited

U.S. PATENT DOCUMENTS 532,335 1/1895 Priest ..... 30/200 X 3,100,342 8/1963 Konig ..... 30/200

3,280,468 10/1966 Rangus ..... 30/200 X 3,295,202 1/1967 Pucino ..... 30/200

3,344,520 10/1967 Williams ..... 30/200

*Primary Examiner*—E. R. Kazenske

*Assistant Examiner*—William Fridie, Jr.

*Attorney, Agent, or Firm*—Michael J. Striker

[57] ABSTRACT

A hair clipper comprised of a stationary blade and a movable clipper blade each provided with teeth cooperating with each other upon the reciprocating swinging movement of the clipper blade to and from the stationary blade to produce hair cut is further provided with an adjusting strip displaceable along the teeth of the stationary blade in the direction of elongation of those teeth so as to adjust the depth of the tooth gaps in the stationary blade.

4 Claims, 1 Drawing Figure

HAIR CLIPPER

BACKGROUND OF THE INVENTION

The present invention relates to a hair clipper which includes a stationary shearing blade normally fixed to a stationary base of the clipper and a movable cutting blade, both blades being provided with teeth and cooperating with each other upon reciprocating swinging of the movable blade to and from the stationary blade to cut hair.

Hair clippers of the foregoing type are known in practice and are used by hairdressers in barber shops. Such hair clippers, however, have been recently rather frequently used by laymen.

Inasmuch as a hairdresser, as a trained specialist, has the necessary skill to clip large quantities of hair locks just with a few courses and therefore uses high cutting capacity of the hair clipper it is necessary for a layman to be very careful in cutting hair to be sure that the executed hair cut is correct. Therefore, maximum possible cutting capacity of the hair clipper used by a layman should be relatively low to prevent an incorrect course of cutting by the hair clipper. It can be also foreseen that with the hair clipper of low cutting capacity potential danger to the head skin of the person having a hair cut can be reduced as with the hair clipper of higher cutting capacity if the hair cut is executed by a hair dresser.

Two kinds of hair clippers can be, of course manufactured one model with larger capacity for barbers and one model with smaller capacity for laymen. This, however, would be more expensive than having one model suitable for hair dressers and laymen as well. Furthermore, a model with variable or adjustable capacity would be more necessary on the market because as a layman gets skill in hair cutting in course of time the model with small capacity is no longer satisfactory to him.

SUMMARY OF THE INVENTION

It is an object of the invention to provide an improved hair clipper.

It is another object of the invention to provide a hair clipper in which its capacity would be adjusted by surprisingly simple means by a user.

These and other objects of the invention are attained by a hair clipper, comprising a stationary blade provided with teeth spaced by tooth gaps from each other, said tooth gaps having a depth; a motor-driven clipper blade also provided with teeth, said clipper blade being reciprocally movable to and from said stationary blade so that the teeth of said clipper blade cooperate with the teeth of said stationary blade to cut hair; and means for adjusting the depth of the tooth gaps of the stationary blade, said adjusting means including a strip-like member displaceable along said tooth gaps to at least partially overlap said gaps. The stationary blade may be spaced from said clipper blade to form a clearance therebetween, the strip-like member being arranged in said clearance and provided with teeth, the teeth of the strip-like member extending into respective tooth gaps to at least partially overlap said respective gaps upon displacing of the strip-like member.

The strip-like member may be toothless and be mounted to the external face of the stationary blade.

Owing to the provision of the hair clipper of the invention with the displaceable strip which adjusts the depth of the tooth gaps of the stationary blade the quantity of hair which is engaged in individual tooth gaps of the hair clipper can be adjusted. If the strip-like member is displaced up to the tips of the teeth cutting capacity of the hair clipper would be about zero; if the strip-like member is displaced in the opposite direction to completely free the tooth gaps cutting capacity of the hair clipper would be maximal comparable to that of the clipper without a strip-like member.

The adjustment of the depth of tooth gaps suggested herein is accomplished by very simple design means so that the hair clipper according to the invention could be in manufacturing not more expensive than customary hair clippers without any adjustment.

Due to the adjustable hair clipper according to the invention a user who would use the clipper must not be necessarily trained in hair cutting. The user can first use the hair clipper with smaller cutting capacity and then, with the training progress adjust the same hair clipper to larger capacity.

In the embodiment, in which the strip-like member is formed with teeth and arranged between the stationary blade and movable blade, the strip-like member does not project beyond the contour of the stationary blade so that a close cut is possible in the same fashion as with conventional hair clippers.

The embodiment with the toothless strip supported on the outside surface of the stationary blade allows for very inexpensive realization of the hair clipper. With this embodiment, hair clippers presently available on the market can be easily modified and equipped with strip-like members according to the invention. Furthermore, the strip-like members can be easily replaced.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
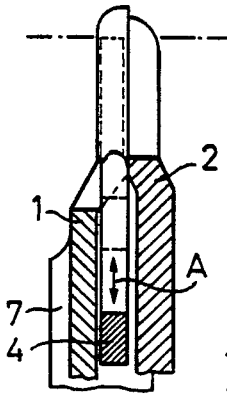
FIG. 1 is a partial sectional view along line I—I of FIG. 2 and illustrates a blade arrangement of a hair clipper according to the invention.
Figure 2:
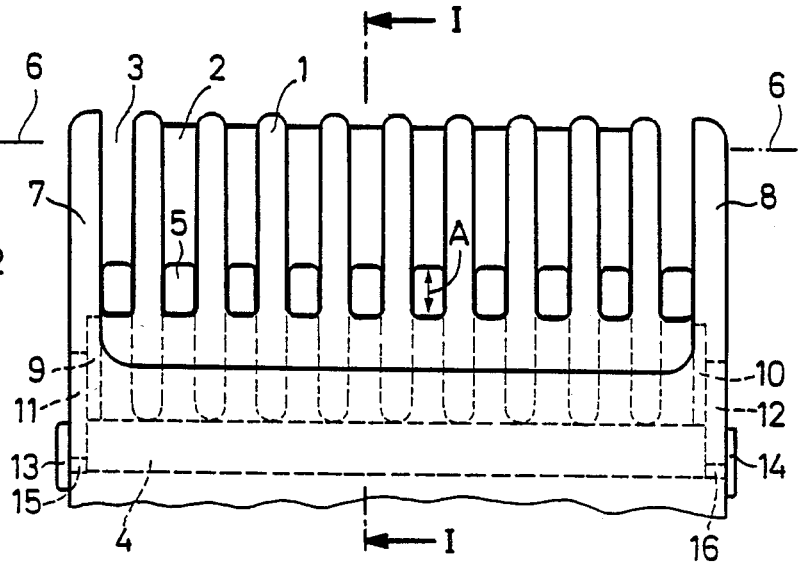
FIG. 2 is a partial front view of the hair clipper according to a first embodiment of the invention.

Referring now to the drawings, and first to FIGS. 1 and 2, a blade arrangement of a hair clipper is shown, which arrangement is composed of a stationary blade or so-called shearing comb 1 and a movable clipper blade or so-called cutting comb denoted by reference numeral 2.

It is to be realized that only the blade arrangement of the hair clipper is shown in the drawings and will be discussed in detail hereinbelow because the remaining portion of the hair clipper is conventional and is disclosed, for example in U.S. Pat. Nos. 1,774,046 or German Auslegeschrift No. 1,209,461. As has been known in the field of hair clippers the movable clipper blade is normally connected to a driving member driven manually or by a motor to impart to the movable blade a reciprocating action so that the teeth of the movable blade pass over the teeth of the stationary blade to cut hair.

The stationary blade 1 and the movable blade 2 are both provided in the known fashion with teeth. As usual, tooth gaps 3 are formed between the teeth of stationary blade 1. Hair locks to be clipped pass into these tooth gaps and are cut off upon the reciprocating swinging of the movable clipper blade 2.

In order to limit the quantity of hair passed into tooth gaps 3 a strip-like member 4 is provided in the blade arrangement according to the invention. Strip-like member 4 is in the embodiment of FIGS. 1 and 2, mounted in a space formed between stationary blade 1 and movable blade 2. Blades 1 and 2 are spaced from each other in the conventional manner. Strip-like member 4 is formed with a plurality of spaced teeth 5 which, upon displacement of member 4, which will be explained herein below, are engaged within respective tooth gaps 3 of stationary blade 1. Member 4 is displaceable in two opposite directions relative to tooth gaps 3 as shown by arrows A. Due to the displacement of teeth 5 within tooth gaps 3 the depths of the latter can be varied and adjusted. If strip-like member 4 is displaced towards the tips of the teeth up to a dash-dotted line 6 so that teeth 5 would almost totally overlap the tooth gaps, 3 as also shown by a dashed line in FIG. 1, then cutting capacity of the hair clipper will be equal to zero.

Since the stationary blade and the movable blade are bent at right angles relative to each other, as shown in FIG. 1, strip 4 with its teeth 5 can move freely into tooth gaps 3 without hindering the movement of the clipper blade 2.

In order to displace strip 4 and guide it in this displacement grooves 9 and 10 are formed in two opposite side walls 7 and 8 of stationary blade 1. Grooves 9 and 10 are extended into slots 11 and 12 which project outwardly of respective grooves 9 and 10 to the end faces of respective walls 7 and 8. Two operation buttons 13 and 14 each provided with a respective pin 15 or 16 are mounted to the opposite faces of walls 7 and 8. Pins 15 and 16 are rigidly connected to strip 4. Upon displacement of operation buttons 13 and 14 and thus pins 15, 16 can strip 4 freely move back and forth in the directions of arrows A and cutting capacity of the hair clipper can be adjusted to a required value.

Figure 3:
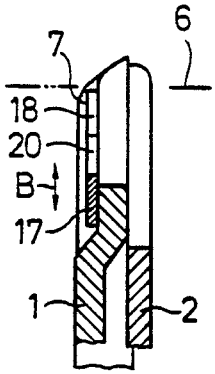
FIG. 3 is a sectional view on line III—III of FIG. 4.
Figure 4:
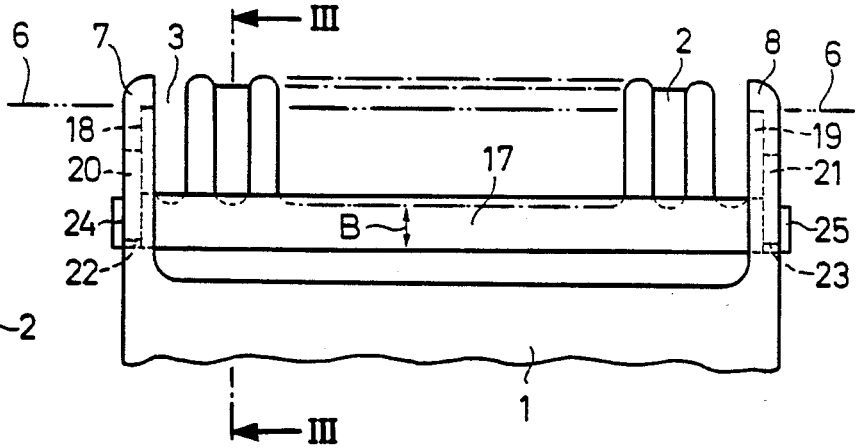
FIG. 4 is a partial front view of the hair clipper according to a second embodiment of the invention.

FIGS. 3 and 4 illustrate another embodiment of the invention. It should be noted that stationary blade 1 and clipper blade 2 are in this embodiment arranged relative to each other in the same manner as in FIG. 1. However, in this embodiment a strip-like member designated here as 17 is not arranged in the space between blades 1 and 2 but is mounted to the stationary blade 1 at the external side thereof. In this construction strip 17 has no teeth, but this strip can, however, be displaced upwardly and downwardly in the directions of arrows B in the same manner as described for strip 4 of FIGS. 1 and 2. Dash-dotted line 6 in FIGS. 3 and 4 indicates the limiting upper point of the displacement of strip-like member 17 towards the tips of the teeth of blade 1. In this position member 17 more or less overlaps the tooth gaps 3 of blade 1.

For guiding the strip-like member 14 towards the tips of the teeth of the stationary blade the side walls 7 and 8 of blade 1 are formed with grooves 18 and 19 which merge into guide slots 20 and 21 extended up to the end faces of respective side walls 7 and 8. Connection pins 22 and 23 interconnected between operation buttons 24 and 25, respectively, and strip-like member 17 can be guided in respective slots 20 and 21. Therefore, in this embodiment, strip-like member 17 can, with the aid of operation buttons 24 and 25, also be displaced upwardly and downwardly in the directions of arrows B.

It is to be understood that the strip-like member 4 as well as the strip-like member 17 can be adjusted with respect to the tooth gaps 3 to both end positions and also to any intermediate position. Such an adjustment can be continuous. For this purpose the hair clipper may be provided with any suitable clamping or any other suitable connection means, of course known in the art, to fix or clamp the strip-like member to the stationary blade in any intermediate position. A gradual or stepwise adjustment can also be carried out in the hair clipper according to the invention. For this purpose suitable conventional arresting or locking means should be provided for each individual position of the strip-like member along the depth of tooth gaps 3.

It should be noted that due to the above-described blade arrangement of the hair clipper the depth of the tooth gaps receiving hair locks during the clipping process is adjusted and the quantity of hair arriving between the teeth will be limited so that cutting capacity of the hair clipper will be reduced when required.

It will be understood that each of the elements described above, or two or more together, may also find a useful application in other types of hair clippers differing from the types described above.

While the invention has been illustrated and described as embodied in a hair clipper, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A hair clipper, comprising a stationary blade provided with elongated teeth spaced from each other by elongated tooth gaps having a depth; a motor-driven clipper blade also provided with teeth, said clipper blade being reciprocally movable in sliding contact relative to said stationary blade so that the teeth of the clipper blade cooperate with the teeth of the stationary blade to cut hair received in said gaps; and adjusting means being non-removable from the clipper during the operation thereof, said adjusting means including a strip-like member movable relative to said stationary blade in two opposite directions over the entire depth of said tooth gaps and being mounted to said stationary blade, said stationary blade having two opposite end walls formed with elongated grooves, said strip-like member being guided in said grooves during its movement relative to said stationary blade for adjusting the depth of the tooth gaps of the stationary blade so as to adjust a hair-storing and cutting area between the teeth of the stationary blade and the teeth of the clipper blade by partially overlapping said gaps to thereby vary said hair-storing and cutting area and adjust the amounts of hair received in said gaps in operation.

2. The clipper as defined in claim 1, wherein said stationary blade is spaced from said clipper blade to form a clearance therebetween, said strip-like member being arranged in said clearance and provided with teeth, the teeth of the strip-like member extending into respective tooth gaps to at least partially overlap said respective gaps upon displacing of the strip-like member.

3. The clipper as defined in claim 1, wherein said strip-like member is toothless and is located at an external face of said stationary blade.

4. The clipper as defined in claim 1, wherein said adjusting means further includes pins into slots formed on the stationary blade and extending said pins are rigidly connected to said strip-like member and provided with operation buttons located externally of said stationary blade and operated for displacing said strip-lke member manually.

* * * * *